US005443681A

United States Patent [19]

Stivani et al.

[11] Patent Number: 5,443,681

[45] Date of Patent: Aug. 22, 1995

[54] DEVICE FOR SPLICING RIBBONS OF SMALL TRANSVERSE DIMENSIONS AUTOMATICALLY

[75] Inventors: Eros Stivani; Alessandro Minarelli, both of Bologna, Italy

[73] Assignee: G. D. S.p.A., Bologna, Italy

[21] Appl. No.: 252,178

[22] Filed: Jun. 1, 1994

[30] Foreign Application Priority Data

Jun. 1, 1993 [IT] Italy ..... B093A0257

[51] Int. Cl.[6] ..... B65H 21/00

[52] U.S. Cl. ..... 156/504; 156/159; 156/505; 242/553; 242/556.1

[58] Field of Search ..... 156/157, 159, 502, 504, 156/505; 242/552, 553, 556.1

[56] References Cited

U.S. PATENT DOCUMENTS

| | | | |
|---|---|---|---|
| 3,089,661 | 5/1963 | Phillips, Jr. et al. | 242/553 |
| 3,717,057 | 2/1973 | Takimoto | 156/502 X |
| 3,939,031 | 2/1976 | Takimoto | 242/556.1 X |
| 4,169,752 | 10/1979 | Tokuno | 156/159 X |
| 4,170,506 | 10/1979 | Marschke | 242/552 X |
| 4,450,039 | 5/1984 | Salvucci et al. | 156/159 X |
| 4,666,541 | 5/1987 | Le Noane et al. | 156/159 X |
| 4,848,691 | 7/1989 | Muto et al. | 242/553 |

FOREIGN PATENT DOCUMENTS

| | | | |
|---|---|---|---|
| 60-61449 | 4/1985 | Japan | 242/553 |
| 2135283 | 8/1984 | United Kingdom | B65H 19/11 |
| 2260532 | 4/1993 | United Kingdom . | |

*Primary Examiner*—Mark A. Osele

*Attorney, Agent, or Firm*—Cushman Darby & Cushman

[57] ABSTRACT

A slender ribbon currently in use and nearing depletion is spliced automatically with a similarly slender new ribbon, held motionless and ready to feed as the replacement for the ribbon in use, by a device comprising a pair of jointing rollers positioned in symmetry on opposite sides of the two ribbons and disposed normally in a standby configuration, stationary, which allows the ribbon in use to pass freely between their two peripheral faces whilst the leading end of the new ribbon is restrained by one of the rollers and distanced from the ribbon in use through the action of an adjacent pulley; in a second configuration, the two rollers contrarotate synchronously and in a direction concurrent with the feed direction of the ribbon in use, completing one full revolution during which the new strip is accelerated initially by the restraining roller to a feed velocity matching that of the ribbon in use, whereupon the two ribbons are sandwiched between two stickers and pinched tight.

9 Claims, 3 Drawing Sheets

24
42
7
9
13
13
4
5
8'
Z
11
11
32
30
10
14
8
2
3
32
12
21
D
C
G
51
14
33
18
25
6
8
23
41
G
51
29
26
28
27
22
28'
3
40
21

Z
9
G
G
4
5
13
24
13
8
2
3
51
Z
42
7
51
31
9
14
33
G
G
30
10
10
32
31
C
D
11
29
25
26
28
21
28'
21
18
41
23
6
F
2
8
3
22

DEVICE FOR SPLICING RIBBONS OF SMALL TRANSVERSE DIMENSIONS AUTOMATICALLY

BACKGROUND of the INVENTION

The present invention relates to a device by which ribbons of small transverse dimensions are spliced automatically.

In the art field of packaging and wrapping related to consumer products, in particular cigarettes or similar articles, the finished packet is enveloped typically in a transparent overwrapping material. It is usual with wrapped commodities of this type to apply a ribbon of small transverse dimensions directly to the outermost wrappings, such that when the moment comes for the packet to be opened, the wrapping can be torn swiftly along a predetermined and well-defined break line.

Automatic machines with the ability to fashion such wrappings are designed to use this type of ribbon; successive ribbons are decoiled each in turn from a respective roll, and, given the slender proportions of the ribbon material, the rolls in question are notably slow to deplete when compared to the rolls from which the overwrapping material is decoiled. As a result, the intervals at which the rolls of ribbon need to be replaced are relatively lengthy, and the operation of joining the trailing end of the depleted ribbon to the leading end of the new ribbon is relatively infrequent. In the context of the overall efficiency of such wrapping machines, therefore, an entirely manual type of changeover has often been considered acceptable, although more recently, as machines have become capable of higher operating speeds, the need has arisen to effect even these changeover operations automatically and as swiftly as possible, to the end of minimizing any delays or down time attributable to the change procedure. Consequently, it has been necessary to concentrate also on the actual step of splicing the ribbons, seeking to obtain still greater precision and speed.

To this end, UK Patent Publication GB 2 260 532 discloses a device by which ribbons of the type in question are spliced automatically. The splice is effected directly by jointing means comprising an element on which the leading end of the new ribbon is positioned and restrained, also a reference and reaction element, disposed on opposite sides of the ribbon in use and capable of movement toward one another to a point at which the leading end of the new ribbon and the trailing end of the depleted ribbon are brought fully into contact. Clearly, in order to perform the splice, which can be effected by heat-sealing or gumming, the jointing means must trap and immobilize the ribbons and thus interrupt their feed motion. To overcome this interruption in the progress of the ribbon, which is drawn forward by suitable drive means nearer to the point of use, it is indispensable to incorporate a tension loop at some stage between the splicing device and the drive means. Nonetheless, the loop does not prevent a reduction in the operating speed of the wrapping machine, which reduces whenever the tension loop is activated.

The object of the present invention is to provide a device for splicing ribbons such as will operate without interrupting the feed motion of the ribbon when activated, and at all events without causing any variation in the rate of the feed, so that the wrapping machine by which the ribbon is utilized can continue to operate at its normal speed.

A further object of the present invention is to provide a splicing device such as will be simple and economical in construction, as well as easy and practical to use.

SUMMARY of the INVENTION

The stated objects are realized according to the invention in an automatic device by means of which to splice slender ribbons, typically a first ribbon supplied to a user machine and currently in use, and a new ribbon restrained motionless and ready to feed as the replacement for the ribbon in use. The device disclosed comprises a pair of jointing rollers cooperating and in substantially tangential association one with another, arranged in symmetry on opposite sides of the two ribbons with their respective axes disposed transversely to the feed direction of the ribbon in use, and designed to assume at least a first operating configuration in which both rollers are motionless, the ribbon in use is able to pass freely between the rollers and the leading end of the new ribbon is restrained by one roller.

In a second operating configuration, the rollers are contrarotated synchronously and in directions concurrent with the feed direction of the ribbon in use, completing one full revolution during which the new strip is accelerated by one of the rollers to a linear velocity not less than the rate of feed of the ribbon in use, whereupon the two ribbons are pinched between the rollers together with a pair of stickers, positioned by the selfsame rollers in such a way as to secure the leading end of the new ribbon to the trailing end of the ribbon in use.

BRIEF DESCRIPTION of the DRAWINGS

The invention will now be described in detail, by way of example, with the aid of the accompanying drawings, in which.

DESCRIPTION of the PREFERRED EMBODIMENTS

Figure 1:
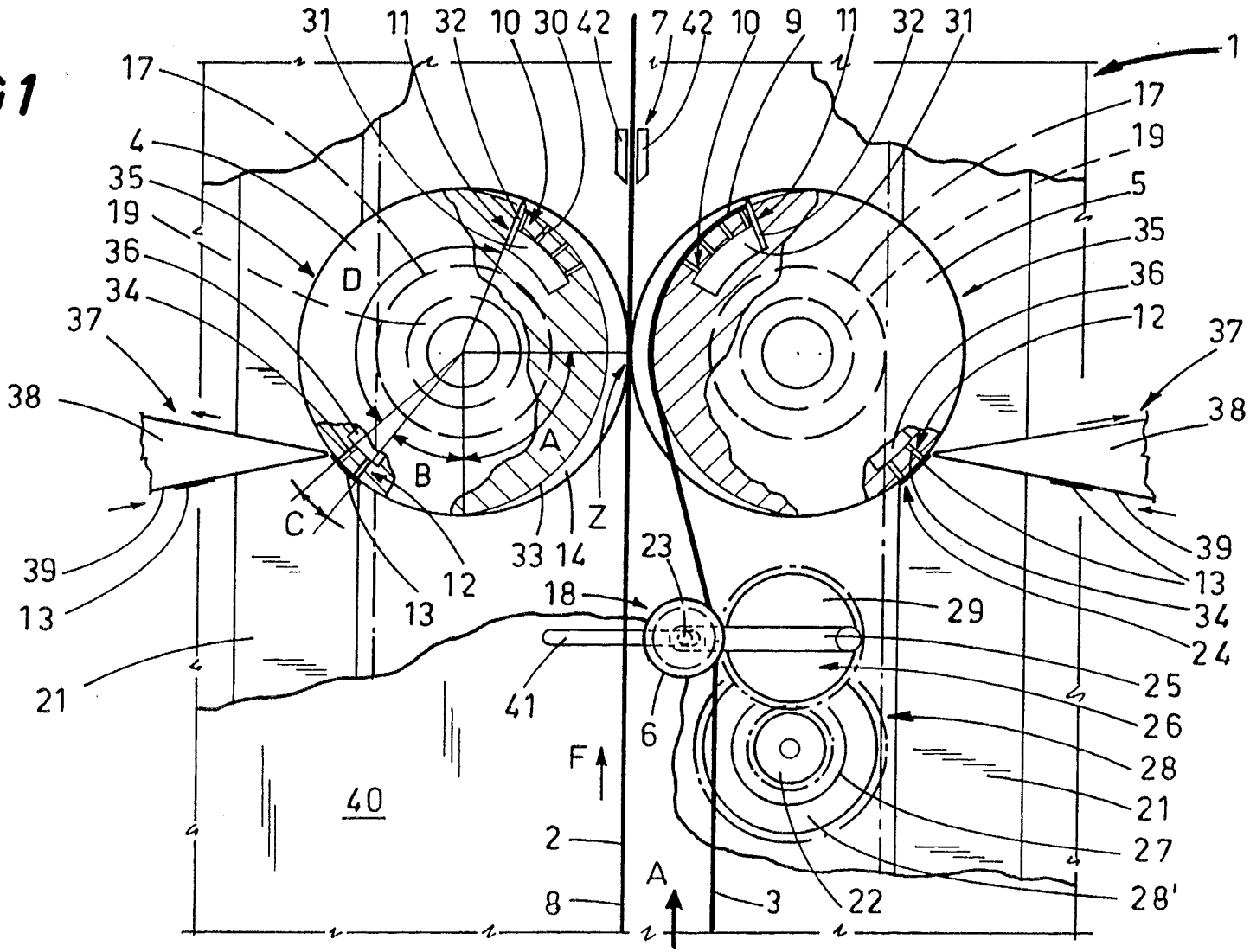
FIG. 1 shows the splicing device according to the present invention in a schematic front elevation, and with certain parts cut away better to reveal others.

Referring to the drawings, 1 denotes a device, in its entirety, by which ribbons of small transverse dimensions are spliced automatically; such a device is designed to join the trailing end 8 of a ribbon in use 2 with the leading end 9 of a new ribbon 3. The ribbons 2 and 3 are coiled for distribution as respective rolls, not illustrated in the drawings. As discernible from FIG. 1, the ribbon in use 2 is fed along the direction of the arrow denoted F by drive means (not illustrated) operating at a point beyond the device in the feed direction.

In the example of the accompanying drawings, the device 1 consists essentially in a pair of contrarotatable jointing rollers 4 and 5 operating in conjunction one with another in such a way as to bring about a permanent connection between the two ribbons 2 and 3, a diverting pulley 6 controlling the trajectory of the ribbons, and first cutting means 7.

Figure 3:
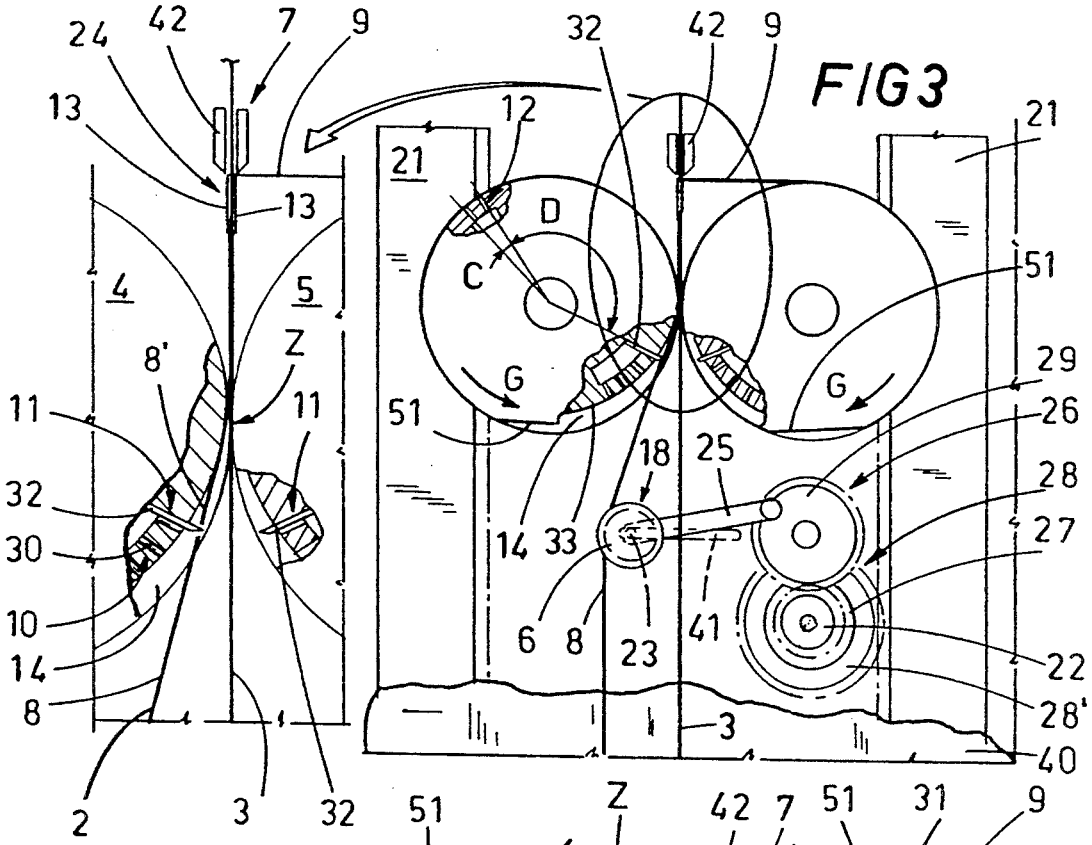
FIGS. 2, 3 and 4 show the splicing device of FIG. 1 in three further elevations, each illustrating a respective operating configuration.
Figure 2:
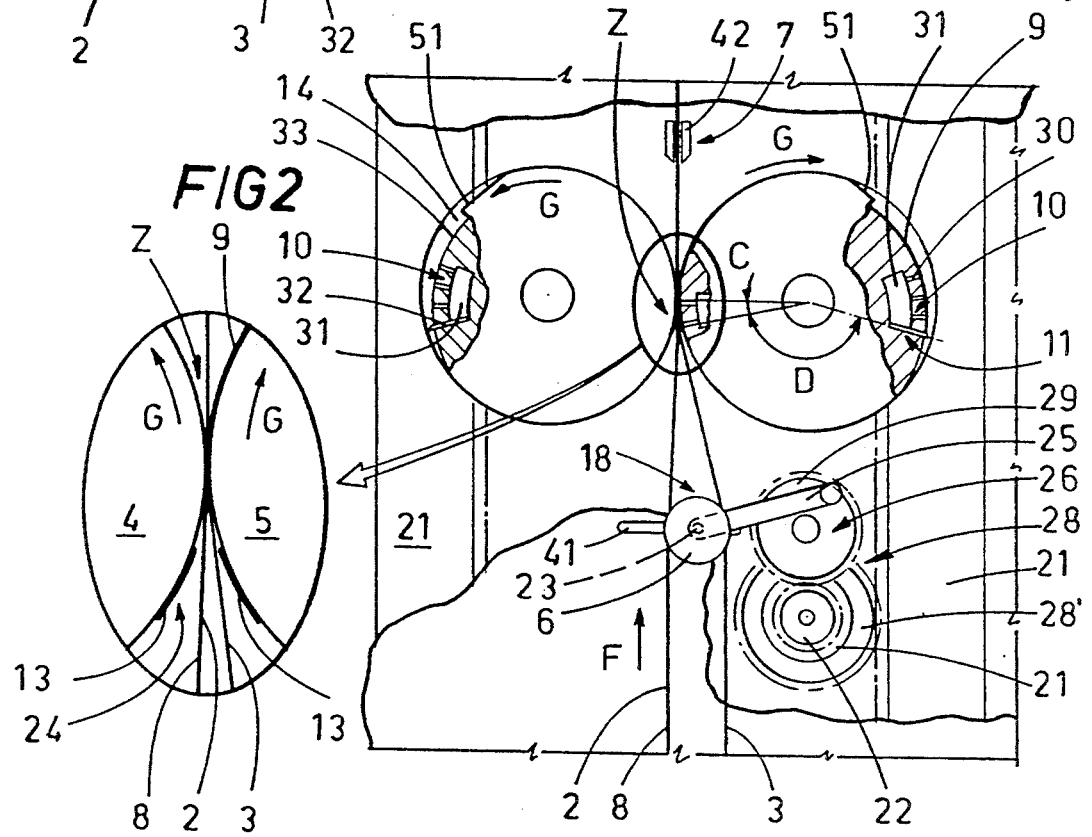

The jointing rollers 4 and 5 are complementarily identical and supported by a frame 40, occupying symmetrical positions on opposite sides of the ribbon in use 2. In the solution illustrated, the two rollers 4 and 5 are disposed with axes mutually parallel and perpendicular to the feed direction F of the ribbon in use 2, and capable of assuming two operating configurations: a standby configuration, in which the ribbon in use 2 is allowed to feed through in the normal manner (as shown in FIG. 1), and a configuration in which the two rollers rotate and the new ribbon 3 is jointed to the ribbon in use 2 (as shown in FIGS. 2 and 3). In the course of the single splicing cycle, and in effect with each rotation, each jointing roller 4 and 5 completes one full revolution.

FIG. 1 illustrates the jointing rollers 4 and 5 in the standby configuration. Departing from a point immediately beyond the zone, denoted Z, of minimum clearance between the rollers 4 and 5, referred to for convenience throughout the specification as the point of tangential proximity, and following the relative peripheries in the direction of rotation denoted G (FIG. 2), that is to say concurrent with the feed direction F of the ribbon in use 2, each roller affords retention means 10 extending and operating along the respective circumference and serving to restrain the leading end 9 of the new ribbon 3, also cutting means 11 capable of severing the ribbons 2 and 3 transversely and at successive moments, and jointing means 24 by which the ribbons are ultimately spliced together (see FIGS. 2 and 3). The retention means 10 and the cutting means 11 are located to coincide with a peripheral channel 14, afforded by each roller 4 and 5. The channel 14 in question extends along an arc of approximately 180° and exhibits a cross sectional profile essentially of V shape (see FIG. 5), affording a bed denoted 33, of which the depth is greatest at mid-point on the arc and diminishes gradually to nothing at the two diametrically opposite ends.

With the two rollers 4 and 5 in the configuration of FIG. 1, the two deeper parts of the respective channels 14 are disposed in mutual opposition at the point of tangential proximity Z, creating a void 16 by which passage is afforded to the ribbon in use 2. In this situation, a portion of each peripheral channel 14 extends back (in relation to the direction of rotation of the rollers 4 and 5) through an arc A of approximately 90°, for reasons that will be made clear in due course.

Observing FIGS. 1 to 4 in particular, retention means 10 consist in a plurality of radial holes 30, each emerging at one end onto the bed 33 of the peripheral channel 14 and connected by way of the remaining end with a chamber 31 incorporated into the body of the respective jointing roller 4 (5). The chamber 31 connects in its turn with a source of negative pressure, not illustrated, in such a way that the retention means 10 are able to produce a restraining action on the leading end 9 of the new ribbon 3. The cutting means 11 lie immediately beyond the holes 30 in the direction of rotation, and consist in a blade 32 disposed and secured in a substantially radial position on the roller 4 (5). More exactly, the blade 32 is positioned in such a manner as to project only from the bed 33 of the peripheral channel 14, without reaching the surface of revolution 35 of the roller 4 (5), for reasons that will become clear in due course.

Figure 7:
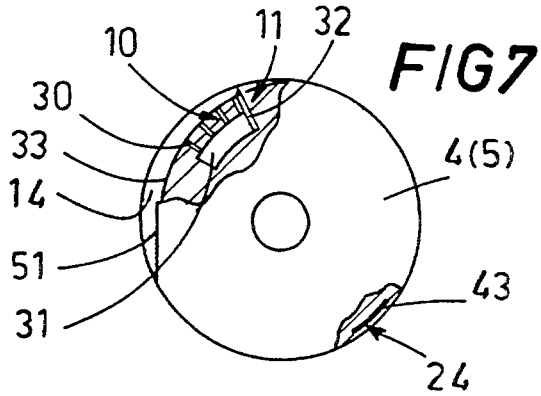
FIG. 7 shows a detail of the device illustrated in the preceding drawings, seen in a schematic front elevation and in an alternative embodiment.

Still observing the rollers 4 and 5, the jointing means 24 occupy a position beyond the compass of the peripheral channel 14, and serve to secure the two ribbons 2 and 3 one to another. Such means 24 can be realized in a variety of ways, depending on the type of material from which the ribbons 2 and 3 are fashioned. In the embodiment of FIGS. 1 to 4, for example, use is made of self-adhesive tabs or stickers 13, whilst in the alternative embodiment of FIG. 7, the selfsame jointing means 24 consist in suitable heater means 43 embedded directly in the body of the roller 4 (5); this latter solution is practicable only in cases where the ribbons 2 and 3 are of heat-sealable material.

Where stickers 13 are utilized, the roller 4 (5) is furnished at the position of the jointing means 24 with suitable second retention means 12, afforded by radial holes 34 emerging externally onto the surface of revolution 35 and connecting internally with a relative chamber 36, which connects in turn with a source of negative pressure not illustrated. The two chambers 31 and 36 of each roller will be connected to the negative pressure source by way of respective valve means, not illustrated, operated in such a way that suction is generated through the corresponding holes 30 and 34 only at the moments prescribed.

The transverse dimension of the stickers 13 or tabs of adhesive material will be greater than that of the ribbons 2 and 3. For increased simplicity and economy, indeed, the stickers 13 might be circular and thus decidedly easier to supply to the point of use, inasmuch as there would be no particular feed alignment required to ensure correct orientation in relation to the ribbon in use 2. Still referring to FIGS. 1 to 4 and observing the roller denoted 4 (the same will also apply for the other roller 5 of the pair), A, B, C and D denote four consecutive areas compassed by four respective angles radiating from the center. These angles A, B, C and D are disposed in sequence around the axis of the roller 4 in the direction opposite to the direction of rotation G, departing from the point of tangential proximity Z. The angle denoted A, as intimated previously, is subtended by the arc compassing the portion of the peripheral channel 14 that precedes the point of tangential proximity Z (in this instance, following the direction of rotation G). The angle denoted C is that compassed by the jointing means 24, whilst the angle denoted D establishes the circumferential distance to the blade 32 from the nearest hole 34 of the jointing means 24. The values of the single angles A, B, C and D can be varied, for reasons to be made clear in due course, in order to optimize the operation of the device 1 and to minimize the length of the portions of ribbon trimmed as waste. For example, reducing the value of angle D has the effect, discernible from FIGS. 2 and 3, of reducing the length of surplus material trimmed from the trailing end 8 of tile ribbon in use 2, which is denoted 8' in FIG. 3.

Where the jointing means 24 are stickers 13, as in the example of FIG. 1, the device 1 will comprise means 37 located close to the rollers 4 and 5, by which the stickers 13 can be supplied to the point of use. Such feed means 37 would be conventional in embodiment, for instance, of the type comprising a wedge element 38 and a belt 39 carrying the single stickers 13; the belt rides flexibly over the wedge element 38, which is positioned in such a way that the tapered end will lie in close proximity to the part of the jointing roller 4 or 5 occupied by the corresponding retention means 12 when the rollers are in the standby configuration.

The aforementioned diverting pulley 6 is located preceding the jointing rollers 4 and 5 along the feed direction F, and serves to distance the new ribbon 3 from the ribbon in use 2, preventing any contact between the two (FIG. 1).

The pulley 6 is mounted to a shaft 23 disposed with its axis parallel to the axes of the two jointing rollers 4 and 5, freely rotatable, and capable thus of translational motion in a direction transverse to the feed direction F of the ribbon in use 2, generated synchronously with the rotation of the rollers 4 and 5.

In translating, the shaft 23 moves along a slot 41 let into the frame 40, by which the shaft itself is also supported, causing the pulley 6 to traverse between two limit positions located on opposite sides of the ribbon in use 2, as discernible from FIGS. 1 to 4. More exactly, on each occasion the rollers 4 and 5 operate to effect a splice between the two ribbons 2 and 3, the shaft 23 and pulley 6 are displaced from one limit position to the other, with the result that the pulley 6 is drawn toward the ribbon in use 2 and away from the new ribbon 3 (see FIG. 4). On completing each such movement, the pulley 6 causes the ribbon in use 2 to be diverted and directed against the nearer roller 5 or 4; the same movement also distances the pulley 6 from the new ribbon 3, which is able in its turn to separate from the restraining roller 4 or 5, as will become clear.

Figure 5:
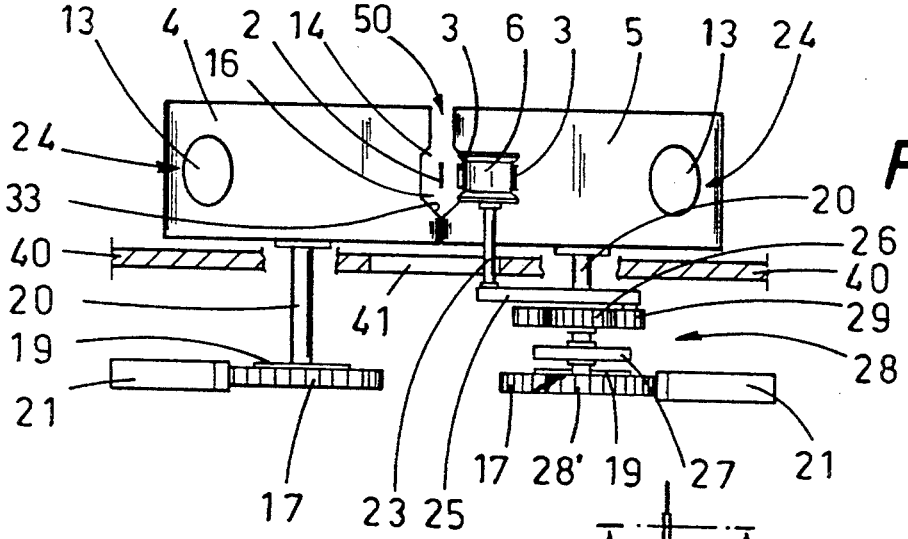
FIG. 5 is the view from "A" of the device in FIG. 1, seen with certain parts in section.
Figure 4:
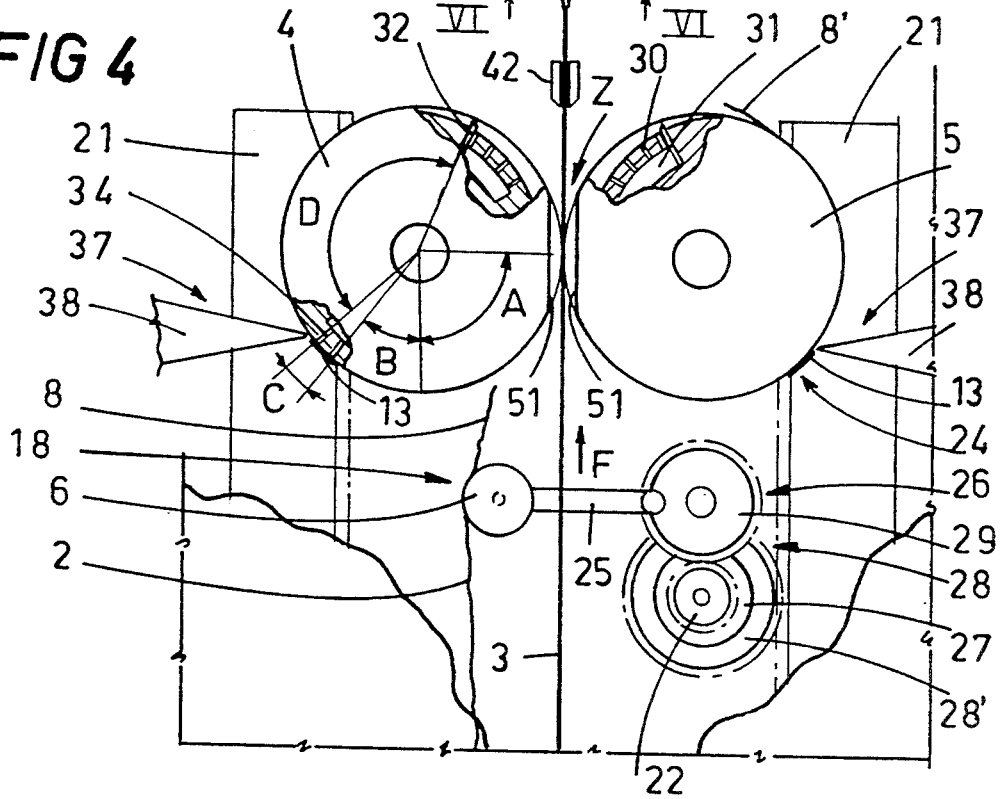

The aforementioned first cutting means 7 occupy a position beyond the jointing rollers 4 and 5, along the feed direction F of the ribbon ill use 2. Such means 7 are mounted to the frame 40 and comprise a pair of fixed blades 42 disposed on opposite sides of the ribbon in use 2. The distance between the blades 42 is greater than the combined thicknesses of the ribbons 2 and 3 and two stickers 13, in such a way that the splice can run through freely. The manner in which the blades 42 are made to operate, indicated in FIG. 3, will be made clear subsequently when describing the operation of the device 1. Each jointing roller 4 and 5 is linked mechanically by way of a respective shaft 20, a unidirectional transmission component or free wheel 19 and a gear wheel 17, to one of two racks 21 capable of axial movement back and forth along a direction parallel with the feed direction F of the ribbon in use 2 (FIG. 5). The racks 21 are rigidly associated with one another, occupying positions on opposite sides of the two rollers 4 and 5 as illustrated in FIGS. 1 to 4, and can be reciprocated thus as one by drive means not shown in the drawings. The free wheel 19 is indicated schematically, being conventional in embodiment and operation, i.e. designed to transmit movement when rotated in one direction, and to turn idle and therefore without transmitting motion when rotated in the opposite direction.

In the solution illustrated, motion is transmitted by the free wheel 19 to the roller 4 or 5 when the rack 21 strokes axially in the direction opposite to the feed direction F (FIGS. 2 and 3), whereas the roller remains motionless when the rack is caused to move concurrently with the feed direction F. As discernible in FIG. 1, which shows the device in the standby configuration, the forward stroke of the racks 21 is an idle stroke, as regards the rotation of the jointing rollers 4 and 5, and the return stroke is the active stroke. The transmission ratio between the racks 21 and the gears 17, also the length of stroke described by the racks, will be such that the rollers 4 and 5 complete exactly one revolution for each active stroke of the racks 21.

It will be seen from FIGS. 1 to 5 that one of the two racks 21 serves also to occasion the movement of the pulley shaft 23, thereby ensuring faultless timing between the jointing rollers 4 and 5 and the diverting pulley 6. In particular, the shaft 23 is pivotably associated with one end of a connecting rod 25, of which the remaining end is pivotably associated with a crank 26. The crank 26 is linked mechanically in its turn to one of the racks 21 by way of a train of gears or other toothed wheels 28 and a unidirectional transmission component or free wheel 27. The crank 26 might consist simply in a gear 29 forming part of the train 28, as indicated in FIGS. 1 to 5. More exactly, the crank gear 29 meshes with a gear denoted 22 linked mechanically by way of the free wheel 27 to a further gear 28', in mesh with the rack 21. The transmission ratios of the train of gears 28 are such that the crank 26 will complete just one half revolution for each forward and return stroke of the rack 21. It will be observed that the crank 26 in fact makes a half revolution only during one stroke of the rack 21, be it forward or back, due to the action of the free wheel 27, which operates in exactly the same manner as the free wheels 19 mentioned previously. In effect, the crank 26 is caused by the rack 21 to make its half turn during the return stroke, and left motionless during the forward stroke, as is the case with the rollers 4 and 5. Other solutions (not illustrated) for operating the two rollers 4 and 5 and the diverting pulley 6 might make use of electric motors to drive the rollers 4 and 5 and a linear actuator to translate the pulley 6.

Figure 6:
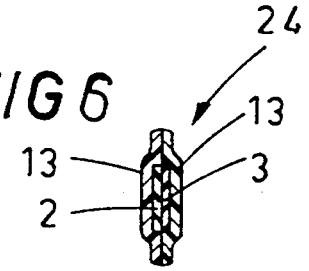
FIG. 6 is the section through VI—VI in FIG. 4.

In operation, the device 1 remains in the standby configuration (FIG. 1) as long as ribbon in use 2 continues to advance toward the user machine, with the jointing rollers 4 and 5 at standstill and the diverting pulley 6 positioned to the right of the ribbon 2, as seen in FIG. 1. In this situation, the new strip 3 is held away from the ribbon in use 2 by the diverting pulley 6 so that the two ribbons are prevented from entering into mutual contact, and the peripheral channels 14 afforded by the two rollers 4 and 5 combine to create a void 16, as mentioned previously, through which the ribbon in use 2 is able to advance freely, making no contact whatever with any part of the rollers 4 and 5 (see also FIG. 5). The standby configuration allows an operator to slip a new ribbon 3 into the void 16 by way of a gap 50, afforded between two flat faces 51 fashioned on the rollers 4 and 5, and position the leading end 9 over the holes 30. Once the holes 30 are connected to the source of negative pressure in such a way as to restrain the leading end 9 of the ribbon 3, the operator can proceed to trim off the excess length by forcing it against the blade 32. The moment for the ribbon to be changed will be indicated by sensing means, not illustrated in the drawings, whereupon the racks 21 are set in motion first concurrently with the feed direction F of the ribbon in use 2 then in opposite direction, thus making a non-operative forward stroke followed by an operative return stroke of equal length. During the return stroke (FIGS. 2 and 3), the crank 26 is caused by the relative rack 21 to rotate through one half revolution. The movement of the crank 26 is transmitted in turn to the connecting rod 25, causing the shaft 23 and the diverting pulley 6 to traverse along tile slot 41, with the result that the ribbon in use 2 is intercepted by the diverting pulley 6 and distanced from the new ribbon 3, thus leaving the ribbon 3 unhindered (see FIGS. 2 and 3, which show the diverting pulley 6 in intermediate positions). During the course of this same return stroke of the racks 21, the jointing rollers 4 and 5 are caused to rotate through one full revolution in the direction denoted G, concurrently with the feed direction F of the ribbon in use 2. At the start of this revolution, the new ribbon 3 will be accelerated by the relative jointing roller 5, in such a way that the velocities of the two ribbons 3 and 2 are matched by the time that the former is brought into contact with the latter. Advancing at the same velocity thereafter, the ribbons 2 and 3 are pinched to a degree between the rollers 4 and 5, and more exactly by the portions of the surface of revolution 35 compassed by the angle denoted B, at which point the stickers 13 are also brought to bear (see FIG. 2): a central band of each sticker 13 will enter into contact with the relative ribbon 2 and 3, whilst the marginal portions on either side adhere one to another, as illustrated ill FIG. 6. Once the stickers 13 have advanced beyond the point of tangential proximity Z, the leading end 9 of the new ribbon 3 will be distanced from the relative jointing roller 5, constrained by the stickers 13 to accompany the ribbon in use 2, and assume a position angled away from the feed direction F in such a way as to be intercepted and cut by the fixed blade 42 nearer to the roller 5 (see FIG. 3). Substantially at the same time, the trailing end 8 of the ribbon ill use 2, now angled away from the feed direction F by the movement of the diverting pulley 6 (which continues to traverse toward the left as viewed in FIG. 3), is directed into contact with the blade 32 of the relative roller 4 and cut through transversely. From this point onward, the rotation of the jointing rollers 4 and 5 serves simply to regain the standby congifuration (FIG. 4); no further contact whatever is made with the new ribbon 3, which becomes the ribbon in use, as the peripheral channels 14 are again brought together to re-establish the void 16 allowing unhindered passage to the ribbon. In this new configuration, the diverting pulley 6 occupies a new operative limit position, on the left of the ribbon now in use 3.

Finally, mention should be made of the importance attaching both to the width of the angles A, B, C and D and to the transmission ratios adopted for the train of gears or wheels 28 described above. In particular, the angle denoted D determines the length of the trailing end 8 of the ribbon in use 2 allowed to run through following the splice, whilst the angle denoted A, as already intimated, provides the delay needed to allow for acceleration of the jointing rollers 4 and 5, and therefore of the new ribbon 3. Naturally, the width of the angles can be controlled, and the transmission ratios selected, in such a way as will ensure that the functional characteristics of the splicing device 1 as a whole are suitably optimized. For example, by increasing the distance traversed by the diverting pulley 6, it becomes possible to reduce the width of angle D, hence also the length of the waste 8′ cut from the trailing end 8 of the ribbon in use 2, as indicated in FIG. 3.

What is claimed is:

1. A device for splicing ribbons of small transverse dimensions automatically, typically a first ribbon currently in use, feeding to a user machine, and a new ribbon restrained motionless and ready to feed as replacement for the ribbon in use, comprising a pair of jointing rollers operating in conjunction and in substantially tangential association one with another during both a first operating configuration and a second operating configuration, arranged in symmetry on opposite sides of the ribbons with their respective axes disposed transversely to the feed direction of the ribbon in use, and designed to assume at least said first operating configuration in which both rollers are motionless, the ribbon in use is able to pass freely between the rollers and the leading end of the new ribbon is restrained by one roller, also said second operating configuration in which the rollers contrarotate synchronously and in directions concurrent with the feed direction of the ribbon in use, completing one full revolution during which the new strip is accelerated by one of the rollers to a linear velocity not less than the rate of feed of the ribbon in use, whereupon the two ribbons are pinched together by both rollers and retained thus between jointing means disposed and operating on the selfsame rollers and designed to secure the leading end of the new ribbon to the trailing end of the ribbon in use.

2. A device as in claim 1, comprising diverting means operating at a point preceding the jointing rollers in relation to the feed direction of the ribbon in use, of which the function is to disallow contact between the motionless new ribbon and the advancing ribbon in use.

3. A device as in claim 1, further comprising first cutting means located beyond the jointing rollers in the feed direction, disposed on opposite sides of the ribbon in use and serving to intercept and sever the leading end of the new ribbon after being jointed to the trailing end of the ribbon in use, wherein the periphery of each jointing roller affords a plurality of means arranged in succession along the direction of rotation and departing from a position beyond a point of tangential proximity between the rollers as considered when in the first operating configuration, namely, first retention means, by which the leading end of the new ribbon is restrained, second cutting means by which the trailing end of the ribbon in use is severed after being jointed to the leading end of the new ribbon, and jointing means by which the leading end of the new ribbon is secured to the trailing end of the ribbon in use.

4. A device as in claim 3, comprising diverting means embodied as a freely revolving pulley disposed between the ribbon in use and the new ribbon and capable thus of movement transversely to the feed direction of the ribbon in use, synchronously with the rotation of the jointing rollers between two limit positions assumed in alternation each time the rollers contrarotate from the first operating configuration through one full revolution, wherein the new ribbon is held away from the ribbon in use by the action of the pulley in each limit position, and the ribbon in use intercepted thereafter by the pulley during its transverse movement, brought into contact with the second cutting means, and severed transversely during the rotation of the jointing rollers.

5. A device as in claim 3, wherein the jointing means consist in stickers of which the transverse dimension is greater than that of the ribbons, and the jointing rollers are furnished each with second retention means serving to restrain one respective sticker by interaction with the non-adhesive face, in such a way that two stickers can be brought into mutual contact by the rotation of the rollers and pinched together with the ribbon in use and the new ribbon sandwiched between.

6. A device as in claim 1, wherein the two jointing rollers are disposed with their respective axes of rotation mutually parallel and perpendicular to the feed direction of the ribbon ill use, their surfaces of revolution lying substantially in mutual contact along an axial generator and affording respective peripheral channels compassing at least the first retention means and the second cutting means and combining to create a void through which the ribbon in use is able to pass freely when the rollers are motionless in the first operating configuration, the second cutting means occupying the respective peripheral channel without projecting beyond the surface of revolution of the respective roller, and the peripheral channels extending back from the point of substantial contact between the surfaces of revolution when the rollers are motionless in the first operating configuration, in the direction opposite to the feed direction of the ribbon in use, through a distance such that the leading end of the new ribbon restrained by the corresponding retention means can be accelerated by the relative jointing roller to a velocity matching that of the ribbon in use before the two ribbons are brought into contact one with another.

7. A device as in claim 2, wherein the jointing rollers are linked mechanically through respective shafts with corresponding live gear wheels coupled by way of respective unidirectional transmission means designed to allow the transmission of motion from the gear wheels to the rollers in such a way that each roller will rotate only in a direction concurrent with the feed direction of the ribbon in use.

8. A device as in claim 7, wherein the gear wheels are engaged in constant mesh with and set in motion by at least one rack caused to reciprocate axially during each step in which the leading end of a new ribbon is spliced with the trailing end of a ribbon in use, completing an idle stroke enabled by the presence of the undirectional means associated with the gear wheels, and an active stroke resulting in the rotation of the jointing rollers through one full revolution.

9. A device as in claim 4 wherein the diverting pulley is freely rotatable about its own axis and mounted thus to a shaft pivotably associated with one end of a connecting rod of which the remaining end is pivotably associated with a crank consisting in a gear wheel linked mechanically to the rack.

* * * * *